US006575225B1

(12) United States Patent
Hohenbichler et al.

(10) Patent No.: US 6,575,225 B1
(45) Date of Patent: Jun. 10, 2003

(54) METHOD FOR THE CONTINUOUS CASTING OF A THIN STRIP AND DEVICE FOR CARRYING OUT SAID METHOD

(75) Inventors: Gerald Hohenbichler, Kronstorf (AT); Gerald Eckerstorfer, Linz (AT)

(73) Assignees: Voest-Alpine Industrieanlagenbau GmbH (AU); Acciai Speciali Terni S.p.A. (IT)

( * ) Notice: Subject to any disclaimer, the term of this patent is extended or adjusted under 35 U.S.C. 154(b) by 0 days.

(21) Appl. No.: 09/646,656

(22) PCT Filed: Feb. 26, 1999

(86) PCT No.: PCT/EP99/01249

§ 371 (c)(1),
(2), (4) Date: Sep. 20, 2000

(87) PCT Pub. No.: WO99/48635

PCT Pub. Date: Sep. 30, 1999

(30) Foreign Application Priority Data

Mar. 25, 1998 (AT) ..... 533/98

(51) Int. Cl.[7] ..... B22D 11/06; B22D 11/16

(52) U.S. Cl. ..... 164/480; 164/485; 164/452; 164/457; 164/475; 164/154.5; 164/428

(58) Field of Search ..... 164/480, 479, 164/485, 4.1, 451–452, 455, 457–458, 475, 66.1, 150.1, 155.1, 154.3–154.5, 415, 428

(56) References Cited

U.S. PATENT DOCUMENTS 5,212,975 A * 5/1993 Ginzburg ..... 239/562
5,253,699 A * 10/1993 Solignac et al. ..... 164/415
5,381,856 A * 1/1995 Fujikura et al. ..... 164/463
5,807,444 A * 9/1998 Paradis et al. ..... 148/542

FOREIGN PATENT DOCUMENTS

| | | |
|---|---|---|
| AU | 50340/96 | 10/1996 |
| AU | A-50340/96 | * 10/1996 |
| EP | 0409645 | 1/1991 |
| EP | 0714716 | 6/1996 |
| EP | 0736350 | 10/1996 |
| JP | 58023549 A | * 2/1983 |
| JP | 402179343 A | * 7/1990 |
| WO | 9322087 | 11/1993 |

OTHER PUBLICATIONS

Patents Abstracts of Japan vol. 007, No. 102 (M–211), Apr. 30, 1983 & JP 58 023549 A (Shin Nippon Seitetsu KK), Feb. 12, 1983 see abstract.

* cited by examiner

*Primary Examiner*—M. Alexandra Elve
*Assistant Examiner*—Kevin McHenry
(74) *Attorney, Agent, or Firm*—Ostrolenk, Faber, Gerb & Soffen LLP

(57) ABSTRACT

A process for continuously casting a thin metal strip controls has jets directed at casting rollers using sensor feedback. Sensor feedback can be taken directly from the rollers, or can be determined indirectly by sensing a condition of the thin metal strip. Surface conditions are controlled over a longitudinal extent of the rollers through locally controlled gas jets. The feedback control of the roller surfaces provides a more uniform casting surface and a more consistent output from the casting surface.

17 Claims, 1 Drawing Sheet

FIG. 1
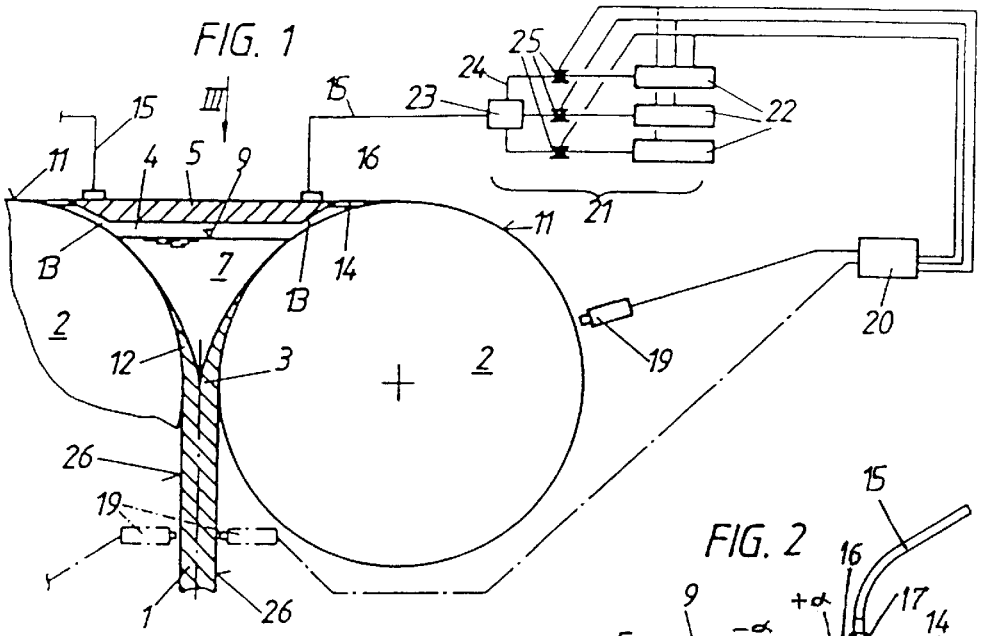
FIG. 2
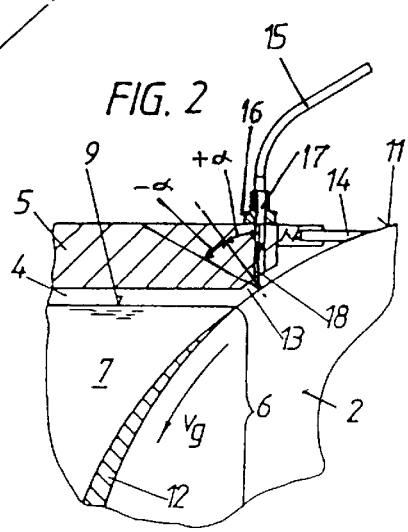
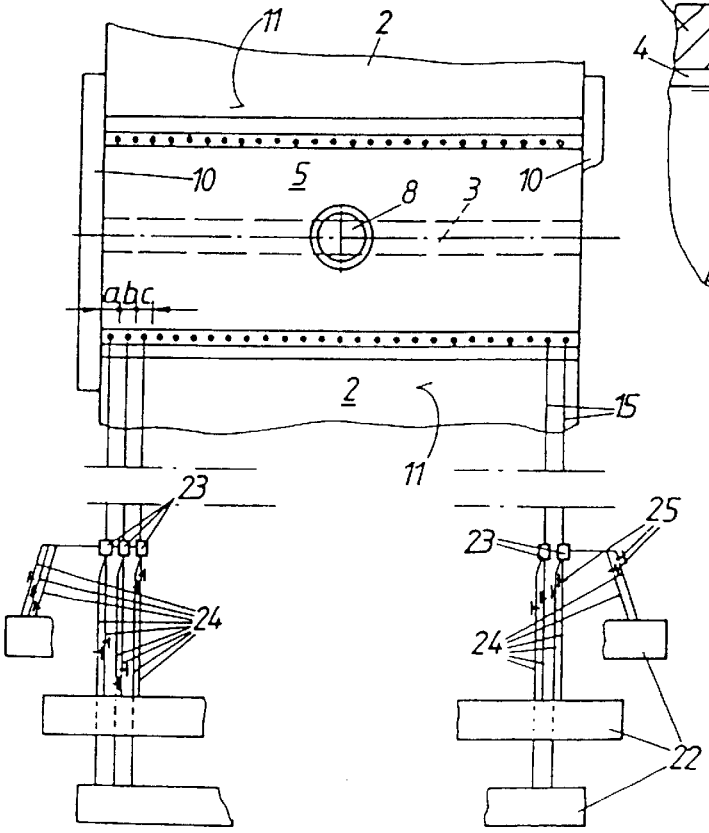
FIG. 3
FIG. 4
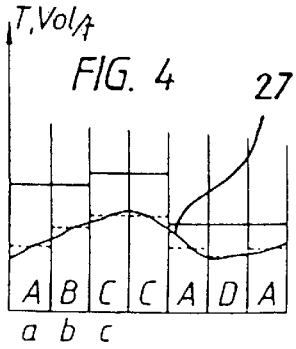

METHOD FOR THE CONTINUOUS CASTING OF A THIN STRIP AND DEVICE FOR CARRYING OUT SAID METHOD

BACKGROUND OF THE INVENTION

1. Field of the Invention

The invention relates to a process for continuously casting a thin strip, in particular a steel strip, preferably having a thickness of less than 10 mm, in a two-roll process, wherein metal melt is cast into a casting gap formed by two casting rolls in the thickness of the strip to be cast while forming a melt bath and the surfaces of the casting rolls above the melt bath are swept with an inert gas or an inert gas mixture as a function of the condition of the surfaces of the casting rolls, as well as to an arrangement for carrying out the process.

2. Description of the Prior Art

When casting a thin strip in a two-roll process, the cross section of the strip is determined by a section of the casting rolls in a hot state. It is essential that the hot section exactly corresponds to the desired strip cross section, since the strip section can no longer be changed after the casting process, i.e. not even by means of a rolling process. The hot section of the casting rolls deviates considerably from the cold section due to the periodically occurring very high thermal loads exerted on the surfaces of the casting rolls. Thermal cambering will be caused, which, however, may be compensated for at least partially by concave rough-grinding of the casting rolls.

The thermal load exerted on the casting rolls in the casting process is, however, influenced by a plurality of parameters. In addition, a strip caster should encompass a wide operating range. Some examples of parameters and operating ranges include: a casting speed range between 0.2 and 2.5 m/s; a strip thickness range between 1 and 10 mm; different rolling forces occurring on the casting rolls; different temperatures of the metal melt to be cast; and different melt qualities such as, e.g., different steel grades, etc. Because of the variation in operating parameters and ranges, sufficient pre-profiling of the casting rolls by rough-grinding is not feasible. Rather, it is necessary to effect an on-line adjustment of the casting roll surfaces for adaptation to different operating points.

Such an on-line adjustment is known, for instance, from AU-A-50 340/96. There, the surfaces of the casting rolls are observed by sensors coupled to a computer. The computer controls a gas feed to the casting rolls, wherein two different gases, i.e. nitrogen and argon, are fed to the casting rolls, and hence to the melt bath in different partial amounts depending on the condition the surfaces of the casting rolls, in order to influence the heat transfer just above the bath level of the melt bath. The mixed gas thus formed is fed to the surfaces of the casting rolls in a manner distributed over the total longitudinal extent of the same. This is to avoid thermal cambering of the casting rolls and to safeguard a uniform thickness of the strip alternative produced. As an alternative, another suggestion is to measure the thickness of the strip distributed over the width of the strip so as to be able to detect deviations from a rectangular cross section of the strip and compensate for the same by appropriate mixing ratios of the gases fed to the casting roll surfaces. As already mentioned, the heat transfer between the casting rolls and metal melt may be decisively influenced by different gas compositions, thus bringing about changes in the geometries of the casting rolls.

Internal research work in the field of two-roll casting has revealed that a satisfactory product cannot be obtained despite the above-described measures. A uniform surface roughness over the total surface casting rolls is not maintained due to thermal deformation of the casting rolls and due to a slightly uneven solidification of the metal melt on the surface of the casting rolls despite the supply of specifically adjusted gas mixtures. Circumferentially oriented smooth sites not extending over the total longitudinal extent of the casting rolls are also observed. Thus, brighter, smoother sites are, for instance, formed on the circumference of the casting rolls. Since such smooth sites, due to their reduced roughness, cause a more rapid solidification of the metal melt and hence a better contact within the casting gap, the so-called "kissing point", which, in turn, induces higher local specific rolling forces, the smoothness of the casting rolls in these areas which are already smoother is intensified. This causes a building-up process and hence an ever increasing deterioration of the strip quality, which cannot be obviated by the above-described measures, i.e. a change in the mixing ratio of the gas fed near the bath level.

SUMMARY OF THE PRESENT INVENTION

The present invention seeks to overcome the drawbacks, disadvantages and difficulties in the prior art. A further object of the present invention is to provide a process, as well as an arrangement for carrying out the process, for the production of a strip having an ideal cross section even with strongly varying operating states. The occurrence of thermal deformations of the casting rolls due to local smooth sites is to be avoided, in particular.

In accordance with the invention, the above objects are achieved by a gas sweeping the surfaces of the casting rolls over the longitudinal extent of the casting rolls in a locally different manner.

A preferred embodiment calls for the surfaces of the casting rolls to be observed over their longitudinal extent with respect to locally different conditions. Gas sweeping of the surfaces of the casting rolls is carried out as a function of local observation.

Preferably, locally different gas sweeping is carried out with locally different gas compositions.

Locally different gas sweeping may, however, also be carried out with locally different gas amounts and/or with locally different gas pressures.

Preferably, locally different surface roughness conditions of the casting rolls are observed.

According to another embodiment, locally different surface reflection property conditions of the casting rolls are observed.

It is, however, also possible to observe locally different discolorations of the surfaces of the casting rolls.

A simple realization of the process is feasible if the surfaces of the casting rolls in the direction of their longitudinal extent are divided into consecutively arranged zones. Each zone is observed with respect to the condition of the surfaces, and locally different gas sweeps in zones, i.e. by gas sweeping that is uniform and constant within each zone. At least three adjacently located zones and up to 40 adjacently located zones are preferably formed.

In a preferred embodiment of the present invention the observation of the surfaces of the casting rolls is carried out by receiving electromagnetic waves emitted and/or reflected from the roll surfaces. In particular, the received waves are in the range of visible light and/or in the range of heat radiation.

According to another embodiment of the invention, the condition of the casting rolls is determined indirectly by observing the cast strip over a width of the strip when emerging from the casting gap. At least one surface of the strip is observed over the strip width immediately after the strip emerges from the casting gap. Electromagnetic waves emitted and/or reflected from the surface of the strip, in particular in the range of visible light and/or in the range of heat radiation, are received and measured.

Preferably, gas sweeping is carried out at a pressure on the gas outlet openings of at least 1.05 to a maximum of 2 bar and, preferably, at least 1.5 bar, wherein gas sweeping is expediently carried out at a gas outlet speed at the gas outlet openings of at least 0.2 m/s and, preferably, at least 1.5 m/s.

An arrangement for continuously casting a thin strip by applying a process according to the present invention is also contemplated. The arrangement includes a continuous casting mold formed by two casting rolls defining a casting gap, wherein the width of the casting gap corresponds to the thickness of the strip to be cast. A melt bath receptacle covered by a lid is formed between the casting rolls above the casting gap. A gas feeding device is provided for feeding an inert gas to the casting rolls and has at least one gas outlet opening just above the melt bath between the casting rolls. A device for observing the surfaces of the casting rolls and a unit for influencing or controlling the gas feed to the casting rolls as a function of the condition of the casting roll surfaces is also provided. Several gas feeding devices are provided, wherein each gas feeding device is associated with a partial surface area of a casting roll. Each partial surface area can be fed with gas by means of the associated gas feeding device as a function of an observed value related to a condition of each partial surface area. The control unit can control the gas feeds based on the observations of the casting rolls.

Preferably, each gas feeding device comprises several closely adjacent gas outlet openings.

A preferred embodiment provides gas feeding devices that are connected to two or more gas reservoirs each containing a different gas. The gas feeding devices are supplied via gas ducts equipped with throttle or shut-off members. The gas ducts of each gas feeding device open into a mixing device, preferably a mixing chamber, associated with the gas feeding device. At least one gas feeding duct leads from the mixing device to the gas outlet opening(s) associated with the gas feeding device.

Expediently, the devices for observing the surfaces of the casting rolls are formed by sensors directed towards the surfaces of the casting rolls.

For a particularly thorough observation of the surfaces of the casting rolls, a profile sensor is provided as the sensor for each of the casting rolls. The profile sensor provides an integral observation of the surfaces of the casting rolls over their longitudinal extent, preferably over their total longitudinal extent.

It is also possible to observe the surfaces of the casting rolls, indirectly, i.e. via the cast strip. The devices for observing the surfaces of the casting rolls are formed by sensors directed towards at least one of the surfaces of the cast strip.

According to another preferred embodiment, two or more, preferably at least three, devices for observing the surfaces of the casting rolls are distributed over the longitudinal extent of the casting rolls. Each of the observing devices are separately coupled with a respective gas feeding device via a control unit.

Preferably, the gas outlet openings are oriented in a circumferential direction with axes of the gas outlet openings directed towards the surfaces of the casting rolls. The axes form an angle with a perpendicular to the casting roll surfaces that are within a range of between about +60° and −60° and, preferably, between about +20° and −30°.

A preferred embodiment is characterized in that the surfaces of the casting rolls have a roughness of more than 4 μm and, preferably, more than 8 μm.

According to a further preferred embodiment, the surfaces of the casting rolls are provided with dimples whose depths are between 10 and 100 μm and whose diameters are between 0.2 and 1.0 mm. The dimples advantageously contact one another, preferably 5 to 20% of the dimples.

Good gas sweeping is ensured if more than 20% of the dimples contact one another.

BRIEF DESCRIPTION OF THE DRAWINGS

In the following text, the invention is explained in more detail by way of two exemplary embodiments schematically illustrated in the drawings in which:

FIG. 1 shows a side view of an arrangement according to the invention for continuously casting a thin strip according to a first embodiment;

FIG. 2 illustrates a detail view of FIG. 1;

FIG. 3 is a top view of the arrangement in FIG. 1 in the direction of the arrow III; and FIG. 4 is a diagram illustrating the gas sweeping of individual circumferential zones.

DETAILED DESCRIPTION OF THE PREFERRED EMBODIMENTS

FIG. 1 shows a continuous casting mold formed by two casting rolls 2 arranged adjacent and parallel to one another are used to cast a thin strip 1, in particular a steel strip having a thickness of between 1 and 10 mm. The casting rolls 2 form a casting gap 3, the so-called "kissing point", on which the strip 1 emerges from the continuously casting mold. Above the casting gap 3, there is formed a space 4 which is upwardly screened by a cover plate 5 forming a cover and which serves to receive a melt bath 6. The metal melt 7 is supplied via an opening 8 of the cover, through which an immersed tube (not shown) projects into the melt bath 6 as far as to below the bath level 9. The casting rolls 2 are provided with an internal cooling system not illustrated. In a lateral direction of the casting rolls 2, side plates 10 are provided for sealing the space 4 receiving the melt bath 6.

A strand shell 12 forms on the surfaces 11 of the casting rolls 2, said strand shells being united to form a strip 1 in the casting gap 3, i.e. at the kissing point. The casting rolls 2 optimally form a strip 1 with an approximately uniform thickness. Strip 1 preferably has a slight curvature conforming to certain standards. The casting rolls 2 create in the casting gap 3 a specific rolling force distribution to achieve optimal uniform thickness of strip 1. The force distribution across the casting rolls 2 can be said to be rectangular in form to provide the various desired essential and operating parameters.

The cover plate 5 is arranged to achieve optimal uniform thickness of strip 1. The force distribution across the casting rolls 2 can be said to be a gap 13 of slight width to provide between the cover plate and the surfaces 11 of the casting rolls 2. The gap 13 is sealed from external air relative to the surfaces 11 of the two casting rolls 2 by means of an optionally resilient sealing lip 14, a labyrinth seal, etc. The edge of the cover plate 5 that is directed towards the casting rolls 2 is adapted in each case to the surfaces 1 of the casting rolls 2 to form a gap 13 having an approximately constant width. Inert gas is fed via gap 13 by means of gas feeding ducts 15. Gas feeding ducts 15 are fastened to the cover plate 5 by means of quick couplings 16. Advantageously, one quick coupling 16 is provided for two or more gas feeding ducts 15 at a time. What is important is a tight and precise connection for gas feeding ducts 15, which may also be the form of a butt joint. The gas pressures in the individual gas feeding ducts 15 need not be identical. FIG. 2 shows bores 17 (which could also be slits) which are provided in the cover plate as an extension of the gas feeding ducts 15. Bores 17 open into the gap 13 between the cover plate and the respective casting roll 2 via a gas outlet opening 18. The bores 17 may also open out at the lower end of the gap 13 in the horizontal edge region of the cover plate 5. The diameters or gap widths of the gas outlet openings 18 are smaller than 5 mm and, preferably, smaller than 3 mm. The gas outlet openings are oriented in a circumferential direction with axes of the gas outlet openings directed towards the surface of the casting rolls 2. The axes form an angle $+\alpha$, $-\alpha$ with respect to a perpendicular to the casting roll surface and that angle is within a range of between about +60° and −60° and preferably between +20° and −30°.

The surfaces 11 of the casting rolls 2 are swept with an inert gas as a function of their condition. The surfaces 11 of the casting rolls 2 are observed with a device 19 (FIG. 1). According to the exemplary embodiment illustrated, a profile sensor 19 is directed in each case towards a surface 11 of a casting roll 2. Sensor 19 measures a temperature profile integrally over the longitudinal extent of each casting roll 2. The profile sensor 19 is coupled with a computer and control unit 20 that are capable of arranging temperature value readings or temperature mean values as allocated to adjacently located partial surface areas a, b, c, etc. I.e., the temperature related values can be ascribed to be individual adjacent circumferential zones a, b, c, . . . distributed over the longitudinal extent of the casting rolls 2 (FIG. 3).

The profile sensor 19 can also be replaced with a radiation sensor for detecting smooth sites on the surfaces 11 of the casting rolls 2.

As shown in FIGS. 1 and 3, a plurality of gas feeding devices are able to influence, by means of inert gas, individual zones of the adjacently located circumferential zones a, b, c, . . . of each casting roll 2 separately and independently of one another. A plurality of gas feeding devices 21 is provided, according to the exemplary embodiment illustrated, each gas feeding device 21 being allocated to a circumferential zone a, b, c, . . . of a casting roll 2.

Compressed gas reservoirs 22 for different gases are provided for gas sweeping. For example, three compressed gas reservoirs 22 according to the exemplary embodiment illustrated, are each filled with a specific gas, e.g. one with nitrogen, one with argon and one with helium. From each of these compressed gas reservoirs 22, gas ducts 24 lead to a mixing chamber 23 associated with one of the circumferential zones a, b, c, etc. A specific gas composition formed from one or more of the gases contained in the compressed gas reservoirs 22 may be set for each of the mixing chambers 23 by means of throttle and shut-off members 25 installed in the gas ducts 24. These throttle and shut-off members 25 are coupled with the controller 20 and are activated by the same such that a specific gas composition in accordance with the temperature profile present over the longitudinal extent of each casting roll 2 may be set for each mixing chamber 23. A specific gas composition can thus be set for each of the circumferential zones a, b, c, etc. The set values to be selected are determined by the controller 20 on the basis of the temperature profiles detected by the respective sensor 19.

A gas feeding duct 15 leads from each of the mixing chambers 23 to a gas outlet opening 18 provided on the edge of the cover plate 5. The surfaces 11 of the casting rolls 2 may each be acted upon by different gas compositions, i.e. locally different gas mixtures. The gas compositions can in general vary locally as viewed in the longitudinal direction of the casting rolls 2, for example, in a circumferential-zone-related manner. It is also possible to combine several adjacently located gas outlet openings 18 (e.g., in the form of bores) to form a group. The group of gas outlet openings can be fed from a single gas feeding duct 15, whereby wider circumferential zones a, b, c, . . . are formed. According to this arrangement, larger surface areas of the surfaces 11 are each supplied with a gas mixture. Hence, a gas feeding device for feeding gas to a circumferential zone a, b, c, . . . is formed from gas ducts 24, their number corresponding to the number of compressed gas reservoirs 22. Throttle and shut-off members 25, a mixing chamber 23, a gas feeding duct 15 and at least one gas outlet opening 18 also contribute to feeding the gas feeding device.

The incoming gas should have impact pressures of at least 1.05 bar and, preferably, more than 1.5 bar up to 2 bar. In addition, the axes of the gas outlet openings 18 may be substantially perpendicular to the casting roll surface. Preferably, the gas outlet openings 18 are inclined in, or opposite to, the direction of movement of the roll surface. More preferably, the gas outlet openings 18 are inclined at an angle + in the range of about ±60° from perpendicular with the roller surface as illustrated in FIG. 2. The choice of the widths of the circumferential zones a, b, c, . . . depends on the possible susceptibility to failures of the casting process, which, in turn, is largely a function of the process parameters.

According to another embodiment of the invention, the surfaces 11 of the casting rolls 2 are not directly observed. A conclusion is drawn as to the conditions of the surfaces 11 of the casting rolls 2 from a direct observation of one of the surfaces 26, or both of the surfaces 26, of the strip 1. Consequently, the sensors 19 in this embodiment are directed towards the surfaces 26 of the strip 1. The placement of the sensor 19 is as immediately as possible after the emergence of the strip 1 from the casting gap 3, as indicated in FIG. 1 by dot-and-dash lines.

The invention is not limited to the exemplary embodiments depicted in the drawing, but may be modified in various respects. It is, for instance, possible to achieve the object underlying the invention by observing the local surface roughness of the casting rolls 2 instead of measuring the locally occurring temperature on the casting roll surfaces 11. Conclusions may also be drawn from observing the surface reflection properties of the casting rolls 2, or of the strip 1, by means of image recognition systems, or locally different discolorations of the surfaces of the casting rolls 2 may be observed and used for selecting the gas composition to be swept towards the circumferential zones.

The surfaces 11 of the casting rolls 2 may also be influenced by additionally adjusting locally different gas amounts and/or locally different gas pressures instead of the local variation of the gas composition.

FIG. 4 represents schematically in diagram form the different feeds of different gas compositions A, B, C, . . . to circumferential zones a, b, c, . . . The individual adjacently arranged circumferential zones a, b, c, . . . are plotted on the abscissa of the diagram. In sum, they correspond to the length of a casting roll 11. In the direction of the ordinate, the temperature values allocated to the individual circumferential zones a, b, c, . . . are plotted, a temperature profile according to line 27 resulting from a very fine measurement. In addition, gas quantity values with which the individual circumferential zones a, b, c, . . . are swept per time unit are plotted in the ordinate direction. References A, B, C, . . . relate to different gas compositions such as may be formed by mixing the different gases contained in the compressed gas reservoirs 22. It is apparent that each temperature mean value of a circumferential zone a, b, c, . . . (the mean values being indicated by broken lines) is allocated a defined gas composition and a defined gas amount to act on the circumferential zones a, b, c, . . .

The invention is based on the idea that local influencing of a partial surface of the overall surface 11 of a casting roll 2 is possible by means of locally differently fed gas mixtures or gas amounts when feeding these gas mixtures just above the melt bath level 9. By way of experiments, it has been shown that different gas mixtures inducing different solidification rates may be introduced even into closely adjacent regions. For example, different solidification rate can even be induced into directly adjacent regions of the melt bath level 9. It is similarly and concurrently possible to exert different influences on adjacently located surface zones or circumferential zones a, b, c, . . . , of the casting rolls 2, thereby preventing the surfaces 11 of the casting rolls 2 from becoming non-uniform. As a result, the surfaces 11 of the casting rolls 2 will require repair or replacement only after considerably longer casting sequences or substantially higher product tonnages than has been the case until now.

By way of an experiment it has been shown that the solidification speed may be kept lower by up to 30% when using 100% argon than with the use of 100% helium. Thus, it was found that zones on the surfaces 11 of the casting rolls 2 exhibiting red-brownish discolorations or stains could be cleared by increasing the supply of helium, which considerably increases the local solidification rate. With an increased supply of helium, the red-brown coloration fades or disappears. Furthermore, it was found that in regions of glossy stains the solidification rate can be reduced by increasing the argon feed, thereby causing the glossy stains to fade and disappear. In general, variable casting roll surface conditions over the longitudinal extent of the casting roils 2 eliminated by the process according to the invention. In addition, the scattering range of the surface quality differences during, or on account of, the casting procedure does not increase. Heat transfer in the event of local changes to the surfaces is influenced by the locally applied gas mixture in such a manner that the changes to the surface are not controlled to prevent an increase of unwanted changes, and cause the occurrence of these changes to decline again. Surface quality is defined by the surface, roughness, optical reflection properties, discolorations, stains, or the presence of striae or dimples, for example.

In accordance with the invention, the solidification structure, in particular the central globulitic-dentric solidification structure, of the strip 1 produced will become more uniform over the total width. Reconditioning (rendering the surfaces 11 of the casting rolls 2 uniform) will be required only after a larger number of casts. Thus, not only the service life of the surface layer, but also, in particular, the service life of the casting rolls 2 as a whole will be markedly increased.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A process for continuously casting a thin metal strip, comprising:

casting a metal melt between two turning casting rolls forming a casting gap;

presenting a fluid to an entire extent of a longitudinal surface of at least one of said casting rolls at a point prior to said surface contacting said metal melt;

obtaining a plurality of indicia of a smoothness characteristic for said at least one of said casting rolls, each of said indicia being related to a portion of said longitudinal surface;

presenting said plurality of indicia to a controller for controlling said fluid presentation based on said indicia;

controlling said fluid presentation with said controller to provide local variations in said fluid over said portions of said longitudinal surface related to corresponding indicia; and locally influencing said smoothness characteristic with said controlled fluid presentation.

2. A process according to claim 1, wherein a combination of said portions of said longitudinal surface represent said entire extent of said longitudinal surface.

3. A process according to claim 1, wherein said local fluid variations provided by said controller are determined by at least one of locally different fluid combinations, amounts and pressures.

4. A process according to claim 1, wherein said indicia of said smoothness characteristic is at least one of surface roughness, surface reflection properties and surface color.

5. A process according to claim 4, wherein said smoothness characteristic indicia are obtained through observing an electromagnetic wave that is at least one of emitted and reflected from at least one of said portions of said longitudinal surface and a surface of said metal strip.

6. A process according to claim 5, wherein said electromagnetic wave is at least one of heat radiation and visible light.

7. A process according to claim 1, wherein said portions of said longitudinal surface are adjacent zones extending along said longitudinal surface.

8. A process according to claim 7, wherein said fluid over said zones is substantially uniform.

9. A process according to claim 1, wherein said fluid is presented to said surface of said casting roll from a fluid outlet opening having a pressure in the range of from about 1.05 bar to about 2 bar.

10. A process according to claim 1, wherein said fluid is presented to said surface of said casting roll from a fluid outlet opening having a speed in the range of from about 0.2 m/s to about 1.5 m/s.

11. A process for continuously casting a thin metal strip, comprising:

casting a metal melt on a turning casting roll;

presenting a fluid to an entire extent of a longitudinal surface of said casting roll at a point prior to said surface contacting said metal melt;

obtaining a plurality of indicia of a smoothness characteristic for said casting roll, each of said indicia being related to a portion of said longitudinal surface;

presenting said plurality of indicia to a controller for controlling said fluid presentation based on said indicia;

controlling said fluid presentation with said controller to provide local variations in said fluid over said portions of said longitudinal surface related to corresponding indicia; and locally influencing said smoothness characteristic with said controlled fluid presentation.

12. A process according to claim 11, wherein said fluid presentation is through fluid supply outlets, and the method comprises individually controlling said fluid supply outlets to provide at least one of locally different fluid combinations, amounts and pressures.

13. A process according to claim 12, further comprising, operating said fluid supply outlets to supply fluid to said corresponding portions of said longitudinal roll with a pressure in a range of from about 1.05 to about 2 bar.

14. A process according to claim 12, further comprising, operating said fluid supply outlets to supply fluid to said corresponding portions of said longitudinal roll with a speed in the range of from about 0.2 m/s to about 1.5 m/s.

15. A process according to claim 12, wherein:

a radial of said at least one casting roll intersects a fluid supply outlet; and the method comprises directing said fluid supply outlet toward said corresponding portion of said longitudinal region at an angle with said radial in the range of from about +60° to about −60°.

16. A process according to claim 15, where said range is from about +20° to a about −30°.

17. A process according to claim 11, wherein said obtaining of indicia of a smoothness characteristic is through sensors, and the method comprises operating the sensors to sense at least one of surface roughness, surface reflection properties and surface color.

* * * * *